US006773188B1

(12) United States Patent
Tamaye

(10) Patent No.: US 6,773,188 B1
(45) Date of Patent: Aug. 10, 2004

(54) FLOWER POT PENS

(76) Inventor: Pia Tamaye, 679 Maalahi St., Wailuku, HI (US) 96793

( * ) Notice: Subject to any disclaimer, the term of this patent is extended or adjusted under 35 U.S.C. 154(b) by 0 days.

(21) Appl. No.: 10/610,378

(22) Filed: Jun. 30, 2003

(51) Int. Cl.[7] ..... B43K 23/02; B43K 29/00
(52) U.S. Cl. ..... 401/131; 401/195; D19/42
(58) Field of Search ..... 401/131, 195, 401/52; 24/10 R, 11 CT, 11 CC; D4/206; D9/335, 336; D19/42, 45, 46

(56) References Cited

U.S. PATENT DOCUMENTS

| | | | | |
|---|---|---|---|---|
| 64,610 A | | 5/1867 | Willets | |
| 1,463,805 A | | 8/1923 | Faber | |
| 1,620,529 A | | 3/1927 | Ferris | |
| 1,842,677 A | | 1/1932 | Kovacs | |
| 2,150,065 A | | 3/1939 | Kahn | |
| 3,570,284 A | | 3/1971 | Hendricks | |
| 4,331,721 A | | 5/1982 | Ayers | |
| 4,678,206 A | | 7/1987 | Leahan | |
| 4,984,379 A | | 1/1991 | Lee | |
| 5,123,548 A | | 6/1992 | Milne | |
| 5,839,712 A | | 11/1998 | Wang | |
| 6,167,596 B1 | | 1/2001 | Berman | |
| 6,200,052 B1 | * | 3/2001 | Pitaniello | 401/131 |
| 6,234,699 B1 | * | 5/2001 | Brode | 401/195 |
| 6,241,413 B1 | * | 6/2001 | Puck et al. | 401/131 |
| 6,332,727 B1 | * | 12/2001 | Hsu | 401/195 |
| D470,886 S | * | 2/2003 | Sheng | D19/42 |

* cited by examiner

*Primary Examiner*—David J. Walczak
(74) *Attorney, Agent, or Firm*—Michael I Kroll

(57) ABSTRACT

A pen holder 14 in the form of a potted plant having a housing 14 resembling a plant pot having a filler 26 supporting a potted plant material such as pebbles 17 with a receptacle 16 extending into the filler forming a cavity for the insertion therein of a pen 12. The pen 12 has a decorative element 24 on one distal end in the form of vegetation, such as a flower, with the pen barrel 28 forming the stalk of the decorative element. The receptacle 16 has a wall conforming substantially to the shape and diameter of the writing instrument 12 whereby the receptacle wall engages and suspends the tip 30 pen from engaging the bottom of the receptacle which prevents damage to the writing instrument tip and also retards the drying process of the ink.

16 Claims, 8 Drawing Sheets

FLOWER POT PENS

BACKGROUND OF THE INVENTION

1. Field of the Invention

The present invention relates generally to arts and crafts and, more specifically, to a pen holder being a decorative design. The pen holder of the present invention is comprised of a pen holder in the form of a potted plant having a housing resembling a plant pot having a filler supporting a potted plant material such as pebbles with a socket extending into said filler forming a cavity for the insertion therein of a pen. The pen has a decorative element on one distal end in the form of vegetation, such as a flower with the pen barrel forming the stalk of the decorative element. When housed the decorative element of the present invention appears to be a potted plant. The pen and decorative element can be removed and the pen retaining its normal function of a writing instrument. The cavity has a wall conforming substantially to the shape and diameter of the writing instrument whereby the cavity wall engages and suspends the tip of the pen from engaging the pit of the cavity which prevents damage to the writing instrument tip and also retards the drying out process of the ink tip due to the cavity wall engaging the barrel of the writing instrument forming a substantially sealed enclosure for the writing instrument tip.

2. Description of the Prior Art

There are other pen holder device designed for holding or partially housing a writing instrument. Typical of these is U.S. Pat. No. 64,610 issued to Wilets on May 7, 1867.

Another patent was issued to Faber on Aug. 7, 1923 as U.S. Pat. No. 1,463,805. Yet another U.S. Pat. No. 1,620,529 was issued to Ferris on Mar. 8, 1927 and still yet another was issued on Jan. 26, 1932 to Kovacs as U.S. Pat. No. 1,842,677.

Another patent was issued to Kahn on Mar. 7, 1939 as U.S. Pat. No. 2,150,065. Yet another U.S. Pat. No. 3,570,284 was issued to Hendricks on Mar. 16, 1971. Another was issued to Ayers on May 25, 1982 as U.S. Pat. No. 4,331,721 and still yet another was issued on Jul. 7, 1987 to Leahan as U.S. Pat. No. 4,678,206.

Another patent was issued to Lee on Jan. 15, 1991 as U.S. Pat. No. 4,984,379. Yet another U.S. Pat. No. 5,123,548 was issued to Milne on Jun. 23, 1992. Another was issued to Wang on Nov. 24, 1998 as U.S. Pat. No. 5,839,712 and still yet another was issued on Jan. 2, 2001 to Berman as U.S. Pat. No. 6,167,596.

U.S. Pat. No. 64,610

Inventor: E. P. Wilets

Issued: May 7, 1867

Disclosed is a rack for holding and suspending whips and other articles, consisting of one or more plates of wood, or other suitable material, in which a series or orifices or perforations is formed, combined with a correspondingly perforated sheet of rubber, or other elastic substances.

U.S. Pat. No. 1,463,805

Inventor: L. W. Faber

Issued: Aug. 7, 1923

The invention is a display stand of the character described, and including a base, a block forming a top piece, supporting means to hold the base and top piece in open spaced relation, said top piece being provided with the transverse opening of a diameter to freely receive an article to be mounted in said stand and of a length to prevent tilting of said article therein, said openig being adapted to receive an article and support the same with one end thereof resting on the base.

U.S. Pat. No. 1,620,529

Iventor: William I. Ferris

Issued: Mar. 8, 1927

The invention discloses a stand for a fountain pen comprising a recess adapted to receive an end of a fountain pen, the wall of said recess being formed with a groove adapted to receive the pen clip.

U.S. Pat. No. 1,842,677

Inventor: Theodor Kovacs

Issued: Jan. 26, 1932

In combination with a pen having a screw-thread on its pen section and an irretractable nib, a protector having a central bore adapted to receive said nib and the pen section of said pen; a shoulder in this bore adapted to bear against the front edge of this pen section, the diagonal distance of the operative front edge of the protector from this shoulder being longer than the diagonal distance of this pen point from the front edge of this screw-thread, the longitudinal section of the protector being such in size and shape in relation to the transverse dimensions of said pen and said nib that the distance from the axis of the protector to the nib point is smaller than the inner radius of the shoulder when the outer edge of the pen section and the front edge of its screw-thread, on its opposite side touch, the inner surface of the bore of the protector, the nib point being at this time within the opening of the shoulder.

U.S. Pat. No. 2,150,065

Inventor: David Kahn

Issued: Mar. 7, 1939

The invention is a simulated ball and socket joint including a socket member and a ball member having a ball end mounted in said socket, both the ball and socket being provided with the serrations forming overlapping interlocking portions whereby the ball is held immovably in the socket.

U.S. Pat. No. 3,570,284

Inventor: Grover E. Hendricks

Issued: Mar. 16, 1971

In a writing pen having a first and second barrel members which house an ink cartridge, said first barrel member having a longitudinal bore therein defined by a tubular wall and an end wall, the inner surface of said tubular wall having a recess therein, said second barrel member having a longitudinal bore therethrough and including an insert part slidably received within the longitudinal bore in said first barrel member, said insert part having a lateral bore therein which communicates with the longitudinal bore in said second barrel member and which registers with the recess in said first barrel member, a lock member slidably received within the longitudinal bore in said second barrel member, said lock member having a recess therein and being shiftable between a lock position wherein its said recess is spaced from said lateral bore and a release position wherein its said recess is positioned in registry with said lateral bore, a detent disposed within said lateral bore and engaging said insert part, said detent having a portion which projects into the recess in said first barrel member when said lock member is positioned in its lock position, said ink cartridge engaging said lock member to urge said lock member into its lock position.

U.S. Pat. No. 4,331,721

Inventor: Anne L. Ayers

Issued: May 25, 1982

A decorative holder for an implement such as a pen, pencil, or thermometer comprising an interwoven base portion including a series of substantially concentric tiers of loops and supporting means for supporting the implement. The holder is made by a method which substantially conceals the intersections of the strand of pliant material from which the base portion is formed to provide a holder having a neat and decorative appearance.

U.S. Pat. No. 4,678,206

Inventor: Daniel P. Leahan

Issued: Jul. 7, 1987

The present invention relates to a combination note pad and pen holder with the pad being formed in the shape of an open flower blossom the pad being adhered to a base member having the same flower shaped peripheral design. The base also includes a depending writing implement receptacle with both the depending receptacle and the writing instrument serving to appear as the stem of the flower.

U.S. Pat. No. 4,984,379

Inventor: Victor Lee

Issued: Jan. 15, 1991

A writing instument is disclosed having a display flag attached to an internal pen holder such that the flag may be displayed either by pulling it laterally through any elongated opening in an external pen holder, or by axially extending the internal pen holder from the external pen holder. A positioning block attached to the internal pen holder limits the relatively axial sliding movement between the internal and external pen holders to prevent the user from completely pulling the internal pen holder from the external pen holder. The writing instrument may also be placed in a base such that the flag may be displayed while the base rests on a desk, table, or the like.

U.S. Pat. No. 5,123,548

Inventor: Alexander P. Milne

Issued: Jun. 23, 1992

A writing implement holder to attach to a surface. The holder includes a base to be attached to the surface and having an underside and an opening. There is a recess in the underside surrounding the opening. A cylinder receives the writing implement and is itself located in the opening in the base. A flange at one end of the cylinder is received in the recess in the underside of the base. The upper surface of the cylinder extends inwardly downwardly and is of such a depth that it prevents the writing implement being used to lever the base from the surface. One plug is received in the writing implement and another plug is received in the base and a cable extends between the two plugs. Each end of the cable is secured beneath a plug so that the writing implement is attached to the base. It is desirable that the plug be tightened and loosened by unconventional means. Accordingly, a tool is also described to engage openings formed in the upper surface of each plug to tighten and loosen the plug. The holder is pleasing in appearance and cannot be removed except with difficulty and, if vandalized, can be economically serviced without removal from the surface.

U.S. Pat. No. 5,839,712

Inventor: Chin-Chi Wang

Issued: Nov. 24, 1998

The present invention relates to a pen holder for holding a pen of variable diameter in a vertical or horizontal position, where the insertion part is rotatable against the base for convient use. The present invention comprises a base and an insertion part, which is vertically rotatably mounted on the base and is made of two halves, the two halves being slidable against each other and, being pressed against each other by two springs, holding the pen in between in a vertical or a horizontal channel.

U.S. Pat. No. 6,167,596

Inventor: James Berman

Issued: Jan. 2, 2001

A pen and pen holder arrangement provides security for retaining the pen and in which no tools are required to replace a used up pen. A pen with a flexible tether that terminates in a ball is employed together with a holder that receives the ball. The holder has a base with an opening adequate to pass the ball through and a transport that rotates within the base so that the ball can be moved from an insertion state to a holding state. In the holding state, the track has a dimension that holds the ball within the holder. A rotatable base cover that rotates with the transport obscures the transport from view and has a longitudinal slot opening enlarged at one end to permit the ball to be passed into the holder and otherwise a slot to permit the tether to move with the ball into the holding state.

While these pen holding devices may be suitable for the purposes for which they were designed, they would not be as suitable for the purposes of the present invention, as hereinafter described.

SUMMARY OF THE PRESENT INVENTION

The present invention discloses a pen holder in the form of a potted plant having a housing resembling a plant pot having a filler supporting a potted plant material such as pebbles with a receptacle extending into the filler forming a cavity for the insertion therein of a pen. The pen has a decorative element on one distal end in the form of vegetation, such as a flower, with the pen barrel forming the stalk of the decorative element. The receptacle has a wall conforming substantially to the shape and diameter of the writing instrument whereby the receptacle wall engages and suspends the tip of the pen from engaging the bottom of the receptacle which prevents damage to the writing instrument tip and also retards the drying process of the ink.

A primary object of the present invention is to use a pen to form a decorative element while maintaining the functionality of the pen.

Another object of the present invention is to provide a decorative element using a pen wherein the pen forms the apparent stalk of a flower.

Yet another object of the present invention is to provide a decorative element using a pen having a flower-like decoration attached to one distal end of the pen.

Still yet another object of the present invention is to provide a decorative element having a base forming a housing that appears to be a flower pot.

Another object of the present invention is to provide a decorative element wherein the base has a filler material contained therein.

Yet another object of the present invention is to provide a decorative element wherein the filler material is covered by a decorative element forming ground cover such as pebbles.

Still yet another object of the present invention is to provide a decorative element wherein a cavity extends from the top of the housing forming a socket for the insertion therein of the pen tip.

Another object of the present invention is to provide a decorative element wherein the cavity within the base conforms to the shape of the barrel of the pen.

Yet another object of the present invention is to provide a decorative element wherein the decorative element housing cavity suspends the pen tip within said cavity and prevents the pen tip from engaging the cavity base.

Still yet another object of the present invention is to provide a decorative element wherein the decorative element housing cavity forms a fitted receptacle for the pen tip to retard the ink from drying out.

Additional objects of the present invention will appear as the description proceeds.

The present invention overcomes the shortcomings of the prior art by providing a pen holder being a decorative design. The pen holder is in the form of a potted plant having a housing resembling a plant pot having a filler supporting a potted plant material such as pebbles with a socket extending into said filler forming a cavity for the insertion therein of a pen. The pen has a decorative element on one distal end in the form of vegetation, such as a flower with the pen barrel forming the stalk of the decorative element. When housed the decorative element of the present invention appears to be a potted plant. The pen and decorative element can be removed and the pen retaining its normal function of a writing instrument. The cavity has a wall conforming substantially to the shape and diameter of the writing instrument whereby the cavity wall engages and suspends the tip of the pen from engaging the pit of the cavity which prevents damage to the writing instrument tip and also retards the drying out process of the ink tip due to the cavity wall engaging the barrel of the writing instrument forming a substantially sealed enclosure for the writing instrument tip.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
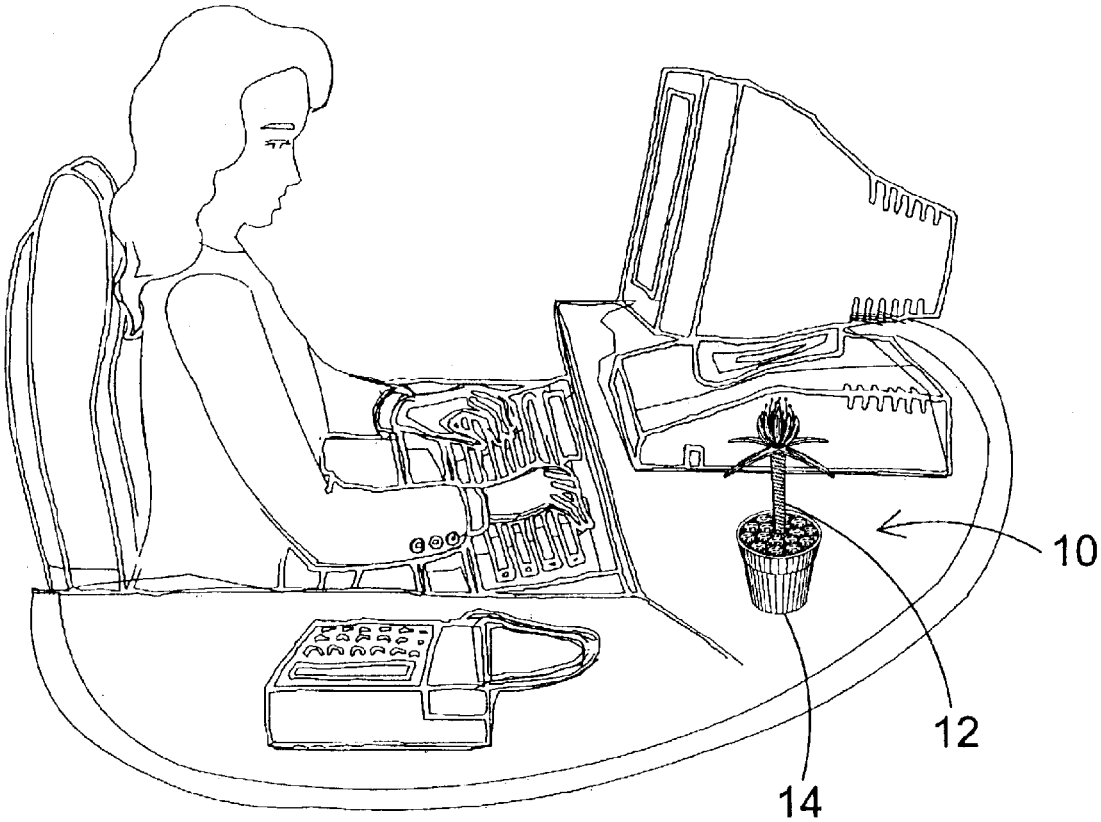
FIG. 1 is an illustrative view of the present invention in use.

With regard to reference numerals used, the following numbering is used throughout the drawings.

10 present invention
12 decorative pen
14 decorative pen holder
16 pen receptacle
17 decorative stones
18 hand
20 weighted element
22 bottom
24 flower
26 filler element
28 barrel
30 tip of pen
32 gel
34 scented molecules
36 top
38 throughbore
40 locking means
42 potpourri reservoir
44 porous cap member
46 potpourri

DETAILED DESCRIPTION OF THE PREFERRED EMBODIMENT

The following discussion describes in detail one embodiment of the invention along with additional embodiments thereof. This discussion should not be construed, however, as limiting the invention to those particular embodiments, since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a decorative pen 12 and pen holder 14 wherein the pen resembles a flower or a plant and the pen holder bears the likeness of a flower pot so that it looks like a potted plant when the pen is placed inside the pen holder. The present invention 10 maintains the functionality of a pen while conspicuously rendering its presence decorative.

Figure 2:
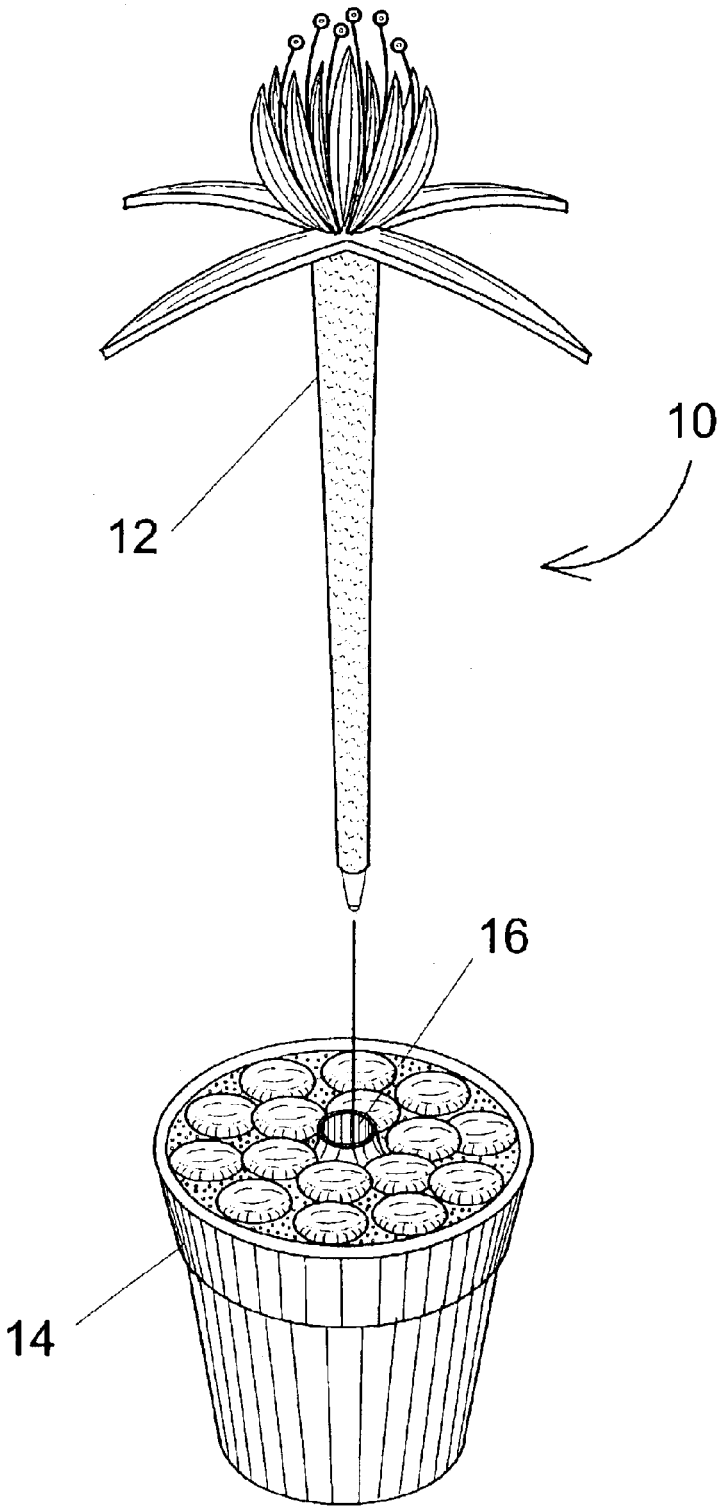
FIG. 2 is an exploded view of the present invention.

Turning to FIG. 2, shown therein is an exploded view of the present invention 10. A pen receptacle 16 is centrally located within the pen holder 14 for placement of the pen 12 therein when not in use so that it is readily available when needed yet aesthetically pleasing.

Figure 3:
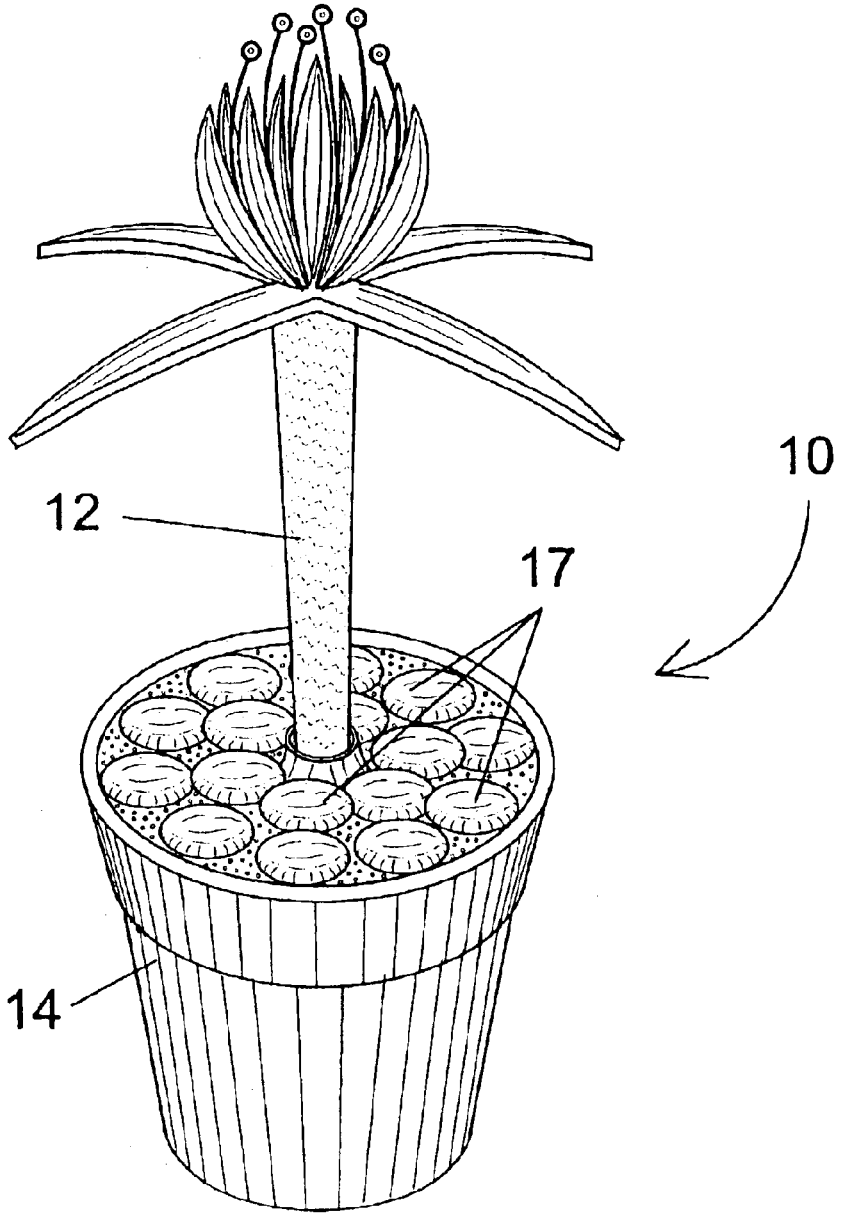
FIG. 3 is a perspective view of the present invention.

Turning to FIG. 3, shown therein is a perspective view of the present invention 10. The pen 12 is securely contained within the pen holder 14 when not in use. The pen holder 14 shown contains decorative marble-like stones 17 but the plant style of the pen 12 and the accessory decorations of the pen holder 14 may vary while still maintaining the concept of the present invention 10.

Figure 4:
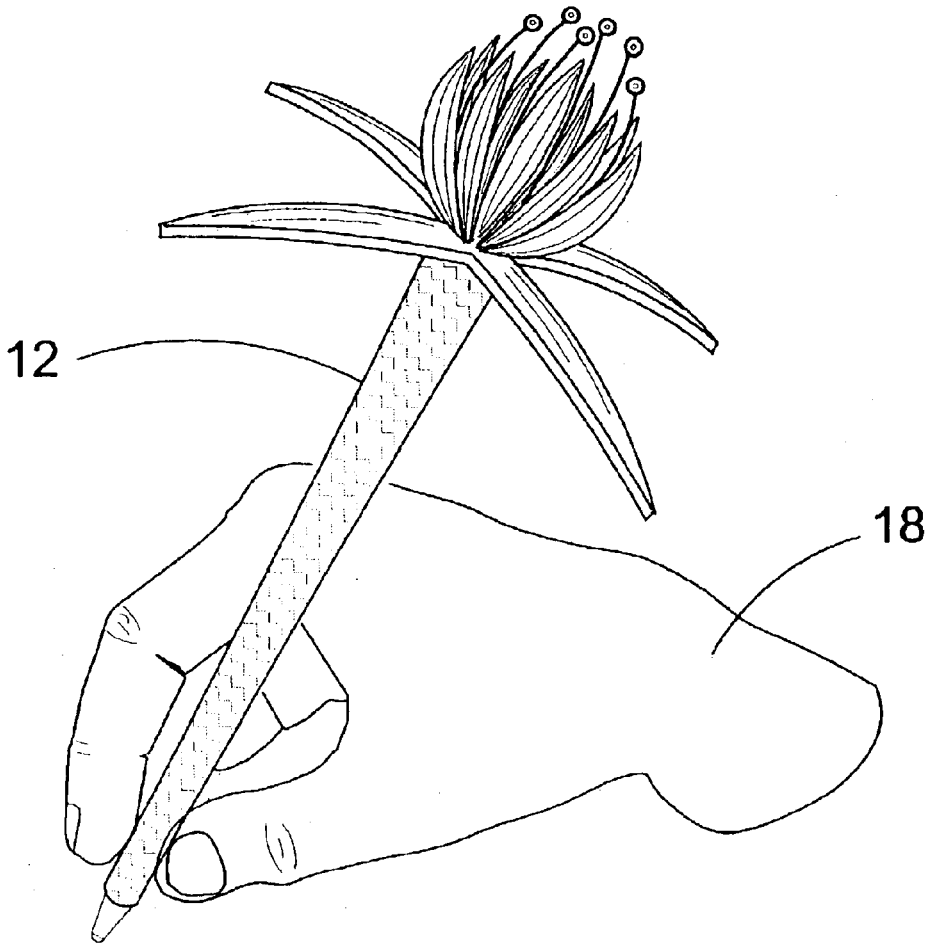
FIG. 4 is an illustrative view of the pen of the present invention in use.

Turning to FIG. 4, shown therein is an illustrative view of the pen 12 of the present invention in use in the hand 18 of a user. The pen 12 of the present invention functions as a conventional pen yet is attractive and whimsical and adds function and beauty to the home or office.

Figure 5:
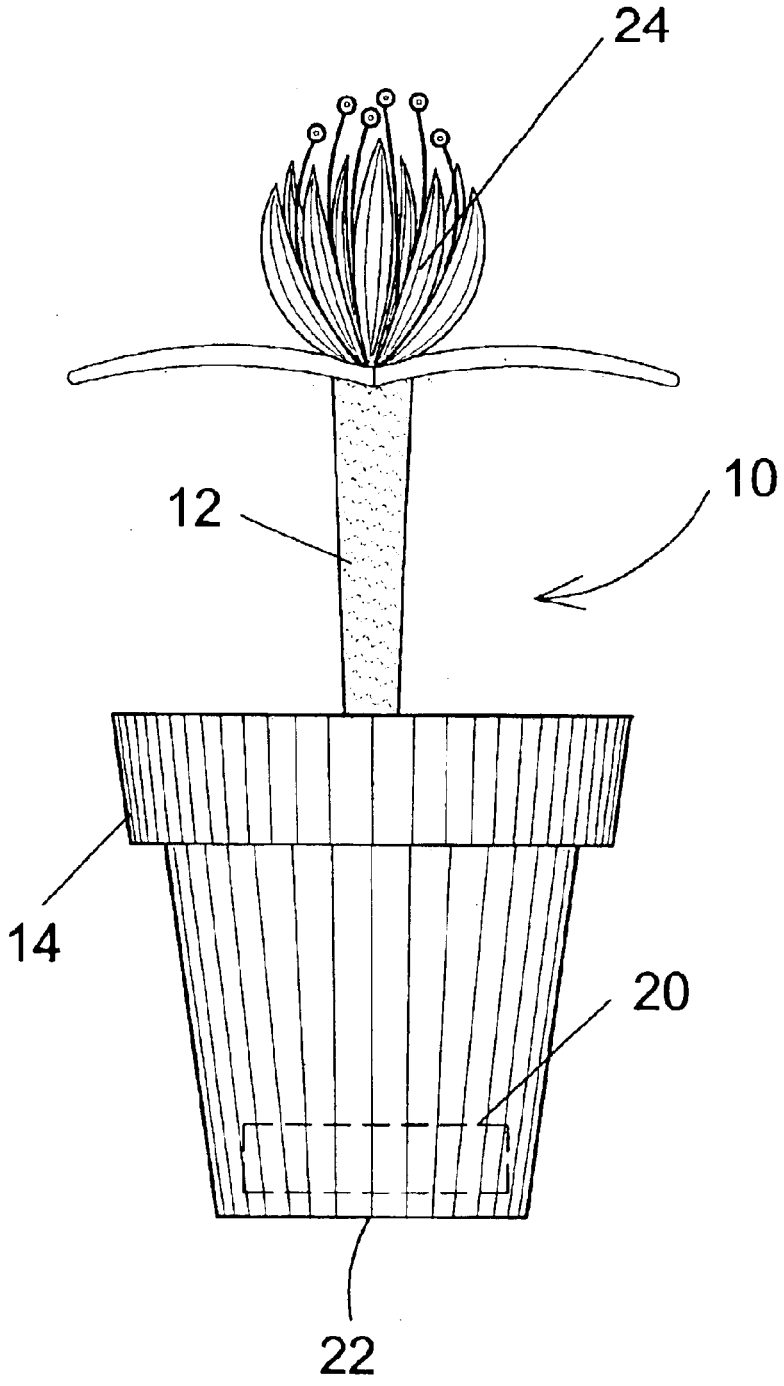
FIG. 5 is the side view of the present invention.

Turning to FIG. 5, shown therein is a side view of the present invention 10. The pen holder 14 of the present invention 10 may include a weighted element 20 on the bottom portion 22 thereof to stabilize it when the pen 12 is in place. The pen 12 also is shown with a decorative flower 24 on the end thereof.

Figure 6:
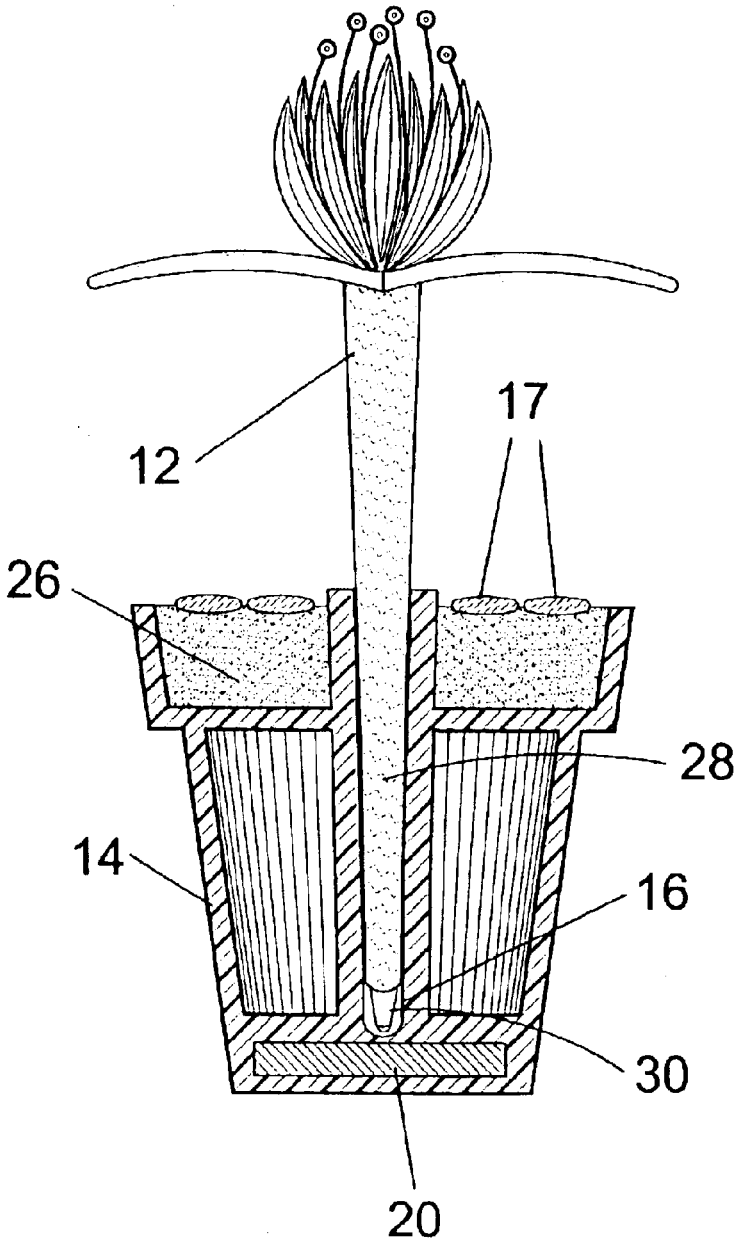
FIG. 6 is a sectional side view of the present invention.

Turning to FIG. 6, shown therein is a sectional side view of the present invention 10. A filler element 26 such as foam or any other suitable material may be used to secure the decorative stones 17 or other ornamental pieces inside the pen holder 14. By creating a holder cavity in the upright standing pen receptacle 16 that conforms to the shape and size of the barrel 28 of the pen 12, the pen tip 30 is air sealed to prevent accelerated drying out. The weighted element 20 is also shown.

Figure 7:
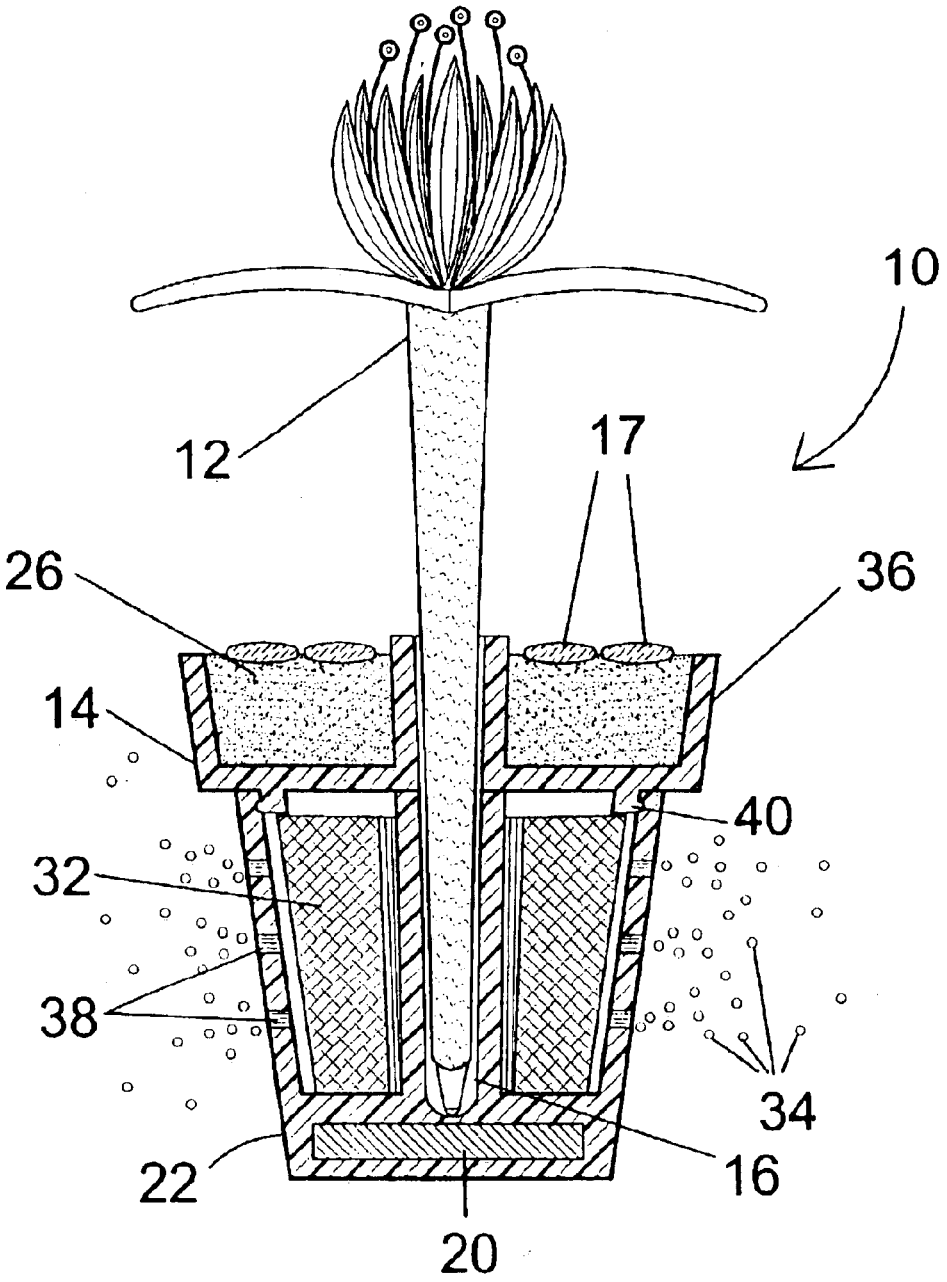
FIG. 7 is a sectional side view of the present invention with an air freshener element.

Turning to FIG. 7, shown therein is a sectional side view of the present invention 10 with an air freshener element. The present invention 10 may also include a scented air freshener element 32 incorporated within the pen-holder 14 thereby enabling the present invention to not only look like a flower or a plant but to smell like one also while fully maintaining the functionality of a pen 12 and pen-holder 14. FIG. 7 demonstrates a fragrant gel element 32 residing within a chamber in the pen-holder with a plurality of through bores 38 to permit the scented molecules 34 released from the gel element to pass into the exterior atmosphere. Furthermore, the top 36 of the pen-holder 14 is removable thereby allowing the user to occasionally replace the gel element 32 with another as needed. A locking means 40 on the pen-holder top 36 is also included to maintain its position on the pen-holder bottom 22 until such time as the removal thereof is desired. Also shown are the decorative stones 17, filler element 26, pen receptacle 16 and weighted element 20. Cavities are provided internal the pen holder 14 for containing the filler 26, gel 32 and weight 20.

Figure 8:
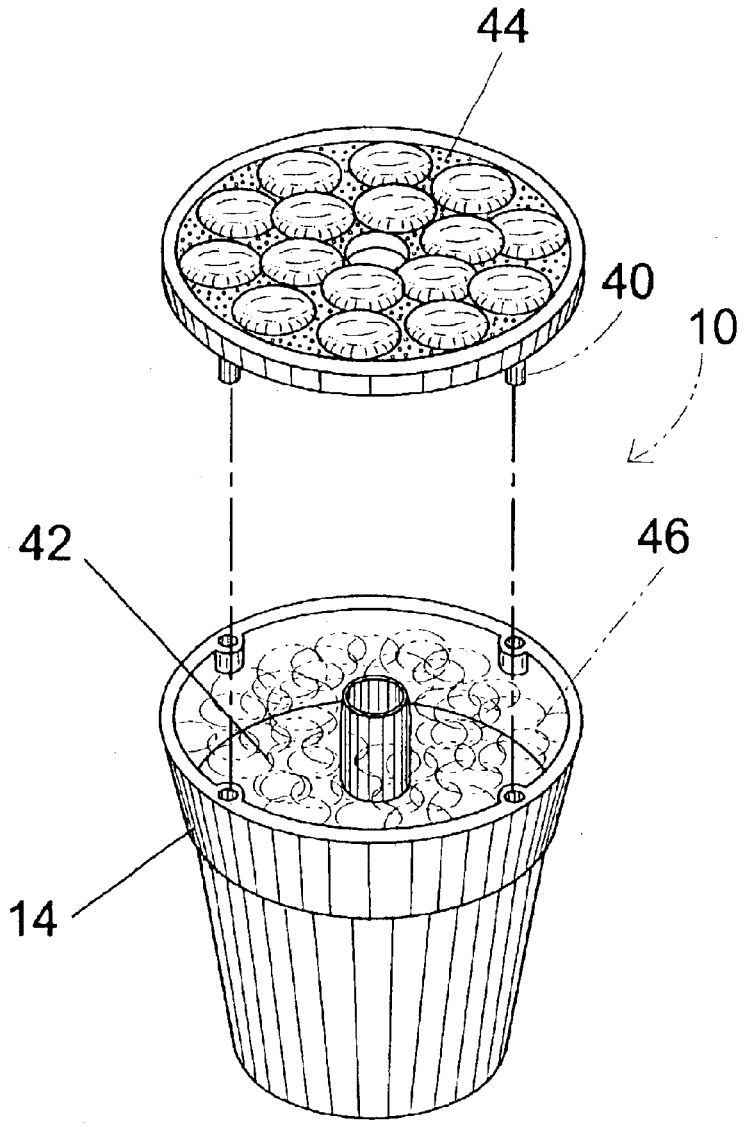
FIG. 8 is an exploded view of the pen-holder with a potpourri reservoir.

Turning to FIG. 8, shown therein is an exploded view of the pen-holder 14 with a potpourri reservoir. Another means of employing a fragrant air freshener element into the pen-holder 14 is demonstrated in FIG. 8, wherein a potpourri reservoir 42 is formed in the uppermost portion of the pen-holder with a porous top cap member 44 with locking means 40 included thereon to maintain the potpourri 46 therein until the user is ready to refresh it. The top of the pen holder may have an outer surface in the shape of decorative items to provide a decorative appearance to the pen holder. The locking means 40 utilizes a plurality of apertures in the top end of the wall of the pen holder 14 for frictionally capturing a plurality of downwardly extending protrusions disposed on the bottom of the cap 44. Other scented fragrance dispensing methods may be used to achieve the objective of the present 10 invention.

I claim:

1. An apparatus for a decorative pen for insertion into a mating decorative pen holder, comprising:

a) a pen, said pen having a first end, a second end, and a barrel disposed between said first and second ends, a tip for writing disposed on said first end, a decorative element disposed on said second end, wherein said barrel forms a portion of said decorative element;

b) a pen holder, said pen holder having substantially the shape of a flower pot, said pen holder having a top end and a bottom end;

c) a pen receptacle centrally disposed in said pen holder having a cavity therein for receiving said tip and said barrel portion of said pen during storage, said pen receptacle having a top end and a bottom end, said pen receptacle being substantially upright standing;

d) said pen holder having a plurality of cavities internal therein, wherein a first cavity is disposed around said pen receptacle adjacent said top end of said pen receptacle, wherein a second cavity is disposed under said pen receptacle adjacent said bottom end, wherein a third cavity is disposed around said pen receptacle between said first cavity and said second cavity;

e) a filler disposed in said first cavity to receive ornamental item placed therein;

f) a plurality of ornamental items disposed in said filler on said top end of said pen holder to decorate the pen holder; and, g) a weight disposed in said second cavity to permit the pen holder to be stabilized when a pen is disposed therein.

2. The apparatus of claim 1, wherein said decorative element disposed on said pen comprises a plant.

3. The apparatus of claim 2, wherein said barrel of said pen comprises a stalk of said plant.

4. The apparatus of claim 3, wherein said cavity of said pen receptacle is complimentarily shaped as said barrel of said pen to permit the tip of the pen to be suspended above the bottom end of the pen receptacle to protect the tip from damage.

5. The apparatus of claim 4, wherein said ornamental items disposed in said filler comprise decorative stones.

6. The apparatus of claim 5, wherein said filler comprises foam.

7. The apparatus of claim 6, further comprising:

a) a fragrant material disposed in said third cavity of said pen holder to emit a fragrant odor;

b) wherein the wall of said pen holder has a plurality of laterally extending apertures therein, said apertures disposed adjacent said third cavity of said pen holder to permit fragrant odor to pass therethrough;

c) a removable top portion of said pen holder disposed on said pen holder, said removable top portion containing said first cavity containing said filler to permit access to the fragrant material contained in said third cavity; and, d) means for locking said removable top portion to the pen holder whereby the removable top portion can be removed and replaced on the pen holder.

8. An apparatus for a decorative pen for insertion into a mating decorative pen holder, comprising:

a) a pen, aid pen having a first end, a second end, and a barrel disposed between said first and second ends, a tip for writing disposed on said first end, a decorative element disposed on said second end, wherein said barrel forms a portion of said decorative element;

b) a pen holder, said pen holder having substantially the shape of a flower pot, said pen holder having a top end and a bottom end;

c) a pen receptacle centrally disposed in said pen holder having a cavity therein for receiving said tip and said barrel portion of said pen during storage, said pen receptacle having a top end and a bottom end, said pen receptacle being substantially upright standing;

d) a top disposed on said top end of said pen holder, said top having a central aperture therein, wherein said pen receptacle passes through said aperture, said top having a plurality of pores therein through which scent passes;

e) said pen holder having a plurality of cavities internal therein, wherein a first cavity is disposed around said pen receptacle adjacent said top, wherein a second cavity is disposed under said pen receptacle adjacent said bottom end of said pen receptacle;

f) a scented material disposed in said first cavity to permit scent to pass through the pores of the top;

g) a plurality of ornamental items disposed on said top on said top end of said pen holder to decorate the pen holder; and, h) a weight disposed in said second cavity to permit the pen holder to be stabilized when a pen is disposed therein.

9. The apparatus of claim 8, wherein said scented material comprises potpourri.

10. The apparatus of claim 9, wherein said top is a removable top to permit access to the scented material.

11. The apparatus of claim 10, further comprising means for locking said removable top to the pen holder whereby the removable top can be removed and replaced on the pen holder.

12. The apparatus of claim 11, wherein said means for locking said removable top to the pen holder comprises a plurality of upright standing apertures disposed in a wall of the top end of the pen holder so that each aperture can frictionally capture a downwardly extending mating protrusion disposed on said top of the pen holder.

13. The apparatus of claim 12, wherein said decorative element disposed on said pen comprises a plant.

14. The apparatus of claim 13, wherein said barrel of said pen comprises a stalk of said plant.

15. The apparatus of claim 14, wherein said cavity of said pen receptacle is complimentarily shaped as said barrel of said pen to permit the tip of the pen to be suspended above the bottom end of the pen receptacle to protect the tip from damage.

16. The apparatus of claim 15, wherein said top of the pen holder has an outer surface in the shape of decorative items to provide a decorative appearance to the pen holder.

* * * * *